United States Patent [19]

Huebner

[11] 4,034,652

[45] July 12, 1977

[54] METHOD AND VALVE FACE CONFIGURATION FOR REDUCING NOISE IN A HYDRAULIC PUMP

[75] Inventor: Robert J. Huebner, Peoria, Ill.

[73] Assignee: Caterpillar Tractor Co., Peoria, Ill.

[21] Appl. No.: 555,926

[22] Filed: Mar. 6, 1975

[51] Int. Cl.[2] ..... F01B 13/04

[52] U.S. Cl. ..... 91/499

[58] Field of Search ..... 91/487, 499, 475, 6.5

[56] References Cited

U.S. PATENT DOCUMENTS

| | | | |
|---|---|---|---|
| 2,749,844 | 6/1956 | Weisenbach et al. | 91/475 |
| 3,200,761 | 8/1965 | Firth et al. | 91/6.5 |
| 3,283,726 | 11/1966 | Kouns | 91/507 |
| 3,382,813 | 5/1968 | Schauer | 91/506 |
| 3,585,901 | 6/1971 | Moon, Jr. | 91/6.5 |
| 3,890,883 | 6/1975 | Romestch | 91/499 |

FOREIGN PATENT DOCUMENTS

| | | | |
|---|---|---|---|
| 1,937,287 | 2/1971 | Germany | 91/499 |
| 1,268,203 | 3/1972 | United Kingdom | 91/499 |
| 1,291,898 | 8/1970 | United Kingdom | 91/499 |

OTHER PUBLICATIONS

The British Hydromechanics Research Association Publication; May 1963.

*Primary Examiner*—William L. Freeh
*Attorney, Agent, or Firm*—Phillips, Moore, Weissenberger, Lempio & Majestic

[57] ABSTRACT

In order to reduce noise within a hydraulic pump of a type having a cylinder barrel defining a plurality of piston bores with the cylinder barrel being rotatable relative to a cylinder head having a valve face for periodically communicating the piston bores with inlet and outlet ports, the valve face is designed to provide overlapping alignment of each piston bore with the inlet passage at a bottom dead center position, subsequent communication of the bore with the outlet port being initiated by a bleed slot. Additionally, the valve face is configured for developing increased clamping engagement between the cylinder barrel and cylinder head by selective communication of each bore with the outlet and inlet ports at a top dead center position. The valve face configuration improves lubrication of the pistons.

4 Claims, 2 Drawing Figures

METHOD AND VALVE FACE CONFIGURATION FOR REDUCING NOISE IN A HYDRAULIC PUMP

BACKGROUND OF THE INVENTION

The present invention relates to a noise reducing improvement within a hydraulic pump. More particularly, the invention is directed toward a configuration of a valve face on a cylinder head for providing periodic communication of piston bores in a rotating cylinder barrel with inlet and outlet passages.

The hydraulic pump or translator unit of the present invention is particularly contemplated for use in applications such as implement control where the pump is employed in combination with a coventional hydraulic motor. A prime mover or engine is coupled in driving relation with the pump while an output means is coupled with the motor. Hydraulic units of this type are commonly employed in a variety of applications to provide variable fluid transmission between the prime mover and powered equipment such as material handling machinery.

Within such a unit, the pump necessarily develops very high fluid pressures in order to operate the hydraulic motor. Pistons within the pump reciprocate between opposite limits of displacement as they are intermittently communicated with inlet and outlet passages. As the pistons reach a limit of reciprocation commonly referred to as "bottom dead center" and begin to move in the opposite direction, fluid pressure within the piston bore tends to be relatively lower than pressure in the outlet port. Upon subsequent communication with the outlet port, fluid tends to flow at a very high velocity in order to equalize pressures referred to above. This high speed flow tends to produce undesirable noise or "knocking" which may also undesirably affect operation of the pump.

It has been known in the prior art to employ either check valves or bleed slots to more nearly equalize pressure in the cylinder bores just prior to each bore entering into communication with an outlet passage in the cylinder head. Although both of these methods suitably reduce noise, they have also been found to exhibit certain deficiencies.

SUMMARY OF THE INVENTION

Accordingly, it is an object of the present invention to overcome problems of the type discussed above.

In particular, it is an object of the present invention to provide a hydraulic pump including means for minimizing undesirable noise during operation.

It is a further object of the invention to provide such a hydraulic pump wherein a valve face providing communication for each of a plurality of piston bores with inlet and outlet ports is configured to reduce noise generation.

It is an even further object of the invention to also configure the hydraulic pump valve face to assist in achieving increased clamping force between a stationary cylinder head and rotating cylinder barrel, thereby eliminating cylinder barrel tipping.

It is also an object of the invention to provide a valve face configuration which would improve cyliner fill characteristics and improve piston lubrication at low outlet pressure.

The configuration of the valve face in accordance with the present invention was developed following a realization that prior art designs commonly terminate communication for each cylinder bore with both the inlet and outlet ports when the respective cylinder bore is in a bottom dead center position. One disadvantage of such a design is that a partial void may exist within the respective cylinder bores due to the low fluid pressure available within the inlet passage. Accordingly, when the piston again experiences extension and the piston bore enters into communication with a high pressure outlet passage, equalizing fluid flow from the passage into the bore causes substantial noise as well as erosion, particularly within those parts of the hydraulic pump which are metering the equalizing fluid flow.

The present invention basically overcomes this problem and achieves the object of noise reduction by providing for at least limited overlapping relation between each of the cylinder bores and the inlet passage when the respective cylinder bore is in a bottom dead center position.

Additional objects, advantages and design features of the present invention are made apparent in the following description having reference to the accompanying drawings.

DESCRIPTION OF THE PREFERRED EMBODIMENT

Figure 1:
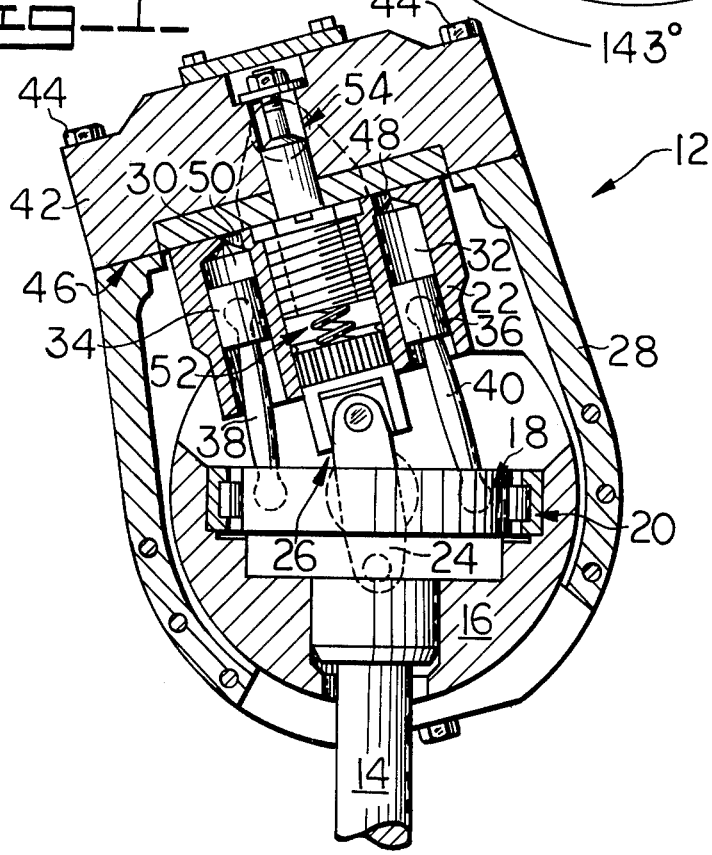
FIG. 1 is a sectioned view of one type of hydraulic pump.

Referring now to FIG. 1, a hydraulic pump is generally indicated at 12. The pump 12 includes a drive shaft 14 which may be coupled with a prime mover or engine (not shown). The drive shaft 14 extends through a stationary housing 16 while being coupled in driving relation with a rotatable flange assembly 18. The flange assembly 18 is journaled within the stationary housing 16 by bearing means indicated at 20.

The drive shaft 14 and flange assembly 18 are also coupled in driving relation with a rotating cylinder barrel 22 by means of a universal joint 26 including a swivel plate 24. Both the stationary housing 16 and the rotating cylinder barrel 22 are arranged within a nonrotating housing 28.

The rotating cylinder barrel forms a plurality of bores such as those indicated at 30 and 32 for respectively receiving reciprocable pistons 34 and 36. Each of the pistons is coupled with the flange assembly 18 by means of a connecting rod. The connecting rods for respectively coupling the pistons 34 and 36 with the flange assembly 18 are indicated at 38 and 40.

Variable displacement for the pump is established by movement or swiveling of the nonrotating housing 28 and cylinder barrel 22 out of axial alignment with the drive shaft 14 and flange assembly 18. Accordingly, the pump is illustrated in FIG. 1 at a relative position of selected displacement. Further, each of the pistons 34 and 36 is illustrated at a limit of reciprocation within its respective bore. For example, the piston 36 is fully retracted into a position commonly referred to as "bottom dead center." Similarly, the other piston 34 is fully extended into its bore 30 at a position commonly referred to as "top dead center."

A stationary head plate 42 is secured to the non-rotating housing 28 by means of cap screws indicated at 44. The head plate 42 forms a valve face 46 arranged for abutting engagement with the rotating cylinder barrel 22. Each of the piston bores 30 and 32 is in communication with the valve face by means of internal passages 50 and 48.

A spring mechanism 52 and retainer assembly 54 maintain the rotating cylinder barrel in close engagement with the valve face 46 of the stationary head plate 42. Because of the high pressures in the pump, it is necessary to maintain close sealing engagement between the rotating cylinder barrel and stationary head plate.

Figure 2:
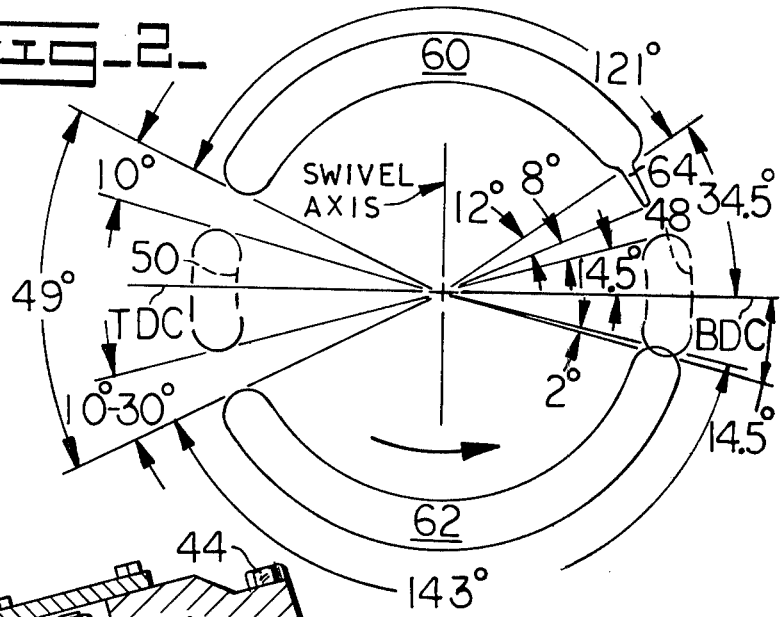
FIG. 2 is a schematic representation of a valve face for a stationary cylinder head of a pump, the valve face being configured according to the present invention in conjunction with an associated rotating cylinder barrel for reducing noise according to the present invention.

Referring also to FIG. 2, the valve face 46 on the head plate 42 forms annular pressure ports 62 and 60 which act respectively as an inlet at relatively low fluid pressure and an outlet subject to high pressure at least when the hydraulic pump is operating under a load.

The relative positions of the interconnecting passages 48 and 50 for the respective piston bores 32 and 30 are also indicated in phantom on FIG. 2. The identity of the pressure ports 60 and 62 as an outlet and inlet respectively is established by rotation of the cylinder barrel and the passages 48 and 50 in a counterclockwise direction relative to the stationary head plate as viewed in FIG. 2.

Within the arrangement described above, as each cyliner port moves past its bottom dead center position represented in FIG. 2 by a passage 48, its piston commences moving upwardly or in extension (as viewed in FIG. 1) in order to pressurize hydraulic fluid within the bore 32. However, pressure developed within the bore 32 may not reach the level of pressure developed within the outlet port 60, particularly when the hydraulic pump is operating under the influence of an external load. Accordingly, upon entry of the bore or its passage 48 into communication with the outlet pot 60, the considerable pressure differential tends to result in a sudden high speed rush of fluid from the outlet port 60 through the passage 48 into the piston bore 32. This resulting high speed pressure fluid tends to cause erosion, particularly within those portions of the cylinder head and cylinder barrel which initially meter fluid flow from the outlet passage into the bore 32.

In order to overcome this problem, the valve face 46 is preferably configured as illustrated in FIG. 2. It is noted that the particular valve face configuration illustrated within FIG. 2 is adapted for a particular pump design of a particular size. Angular arrangement of components upon the valve face 46 is illustrated in FIG. 2 only for purposes of exemplifying the valve face configuration for such a singular pump. It will, of course, be obvious that the angular proportions for the valve face may be varied from what is shown in FIG. 2 within the scope of the present invention.

In order to minimize noise generation, the bottom dead center position of each bore or its interconnecting passage, as indicated at 48, includes limited overlapping communication with the low pressure inlet passage 62. A bleed slot 64 subsequently initiates communication between the bore or its passage 48 with the high pressure outlet passage 60 to control the rate of pressure change within each cylinder.

Even further, the angular configuration for the valve face 46 is designed to permit increased travel of each piston bore, between the outlet and inlet passages 60 and 62, as its piston passes top dead center compared to the amount of travel experienced by each bore or its passage 48 when it traverses the bottom dead center between the inlet and outlet ports 62 and 60. For example, in the valve face design of FIG. 2, it may be seen that each passage providing communication with one of the piston bores, such as those indicated at 48 and 50, has an angular length of 29°. The interconnecting passage 48, which is at the bottom dead center position, overlaps the inlet port 62 by a limited amount of approximately 2°. Also, when the interconnecting passage 48 is at its bottom dead center position, it is angularly spaced apart from initial communication with the bleed slot 64 by approximately 8°. From the above angular values, it may be seen that the overall angular spacing between the inlet port 62 and the bleed slot 64 is approximately 35°. On the other hand, each interconnecting passage such as that indicated at 50 must traverse an angular spacing of 49° or more between the outlet and inlet ports 60 and 62 while passing a condition of top dead center.

This particular spacing feature of the valve face design tends to permit development of increased clamping engagement between the stationary head 42 and the rotating cylinder barrel near top dead center, as may be seen by reference also to FIG. 1.

The present invention even more particularly contemplates increased spacing between the interconnecting passage 50 and the inlet port 62, when the passage is in its top dead center position as illustrated in FIG. 2, relative to spacing between the passage 50 at its top dead center position and the outlet port 60. Such a relationship may be established, for example, by maintaining the 10° spacing illustrated between the outlet port 60 and the passage 50 at its top dead center position while selecting the angular spacing between the passage 50 and the inlet port 62 to be within a range of, for example, 10° to 30+. This configuration facilitates improved lubrication between the piston and cylinder bore when the pump is operating at low outlet pressure.

Through this configuration, fluid remaining within the cylinder bore in communication with the passage 50 is pressurized somewhat higher than pressure in the outlet port 60. Accordingly, a clamping force may be developed between the cylinder head and rotating cylinder barrel as referred to above.

In addition, since work or energy from a prime mover (not shown) is required to pressurize fluid within the cylinder bore as described above, communication of its interconnecting passage with the inlet port 62 is delayed so that the work or energy employed in pressurizing fluid within the cylinder bore may be recovered by expansion of the fluid within the cylinder bore after the piston commences to be etracted within its bore. Once the input work or energy has been recovered, the interconnecting passage 50 then enters into communication with the inlet port 62 so that fluid from the inlet port 62 may again fill the piston bore.

What is claimed is:

1. In a hydraulic pump of a type having a cylinder head mounted in relation with a rotatable cylinder barrel, the cylinder barrel having a plurality of bores each reciprocably mounting a piston, the cylinder head forming a high pressure outlet port and a low pressure inlet port circumferentially arranged upon a valve face for periodic communication with the piston bores, the cylinder barrel also forming interconnecting passages for respectively communicating each piston bore with the valve face on the cylinder head, reciprocation of the pistons being timed in accordance with relative rotation between the cylinder head and the cylinder barrel, the improvement comprising configuration of the valve face upon the cylinder head to provide overlapping communication between each piston bore and the low pressure inlet port when the interconnecting passage for the respective bore is in a position corresponding to full retraction of the respective piston, the valve face forming a bleed slot for subsequently initiating communication of each interconnecting passage with the high pressure outlet ports, wherein the angular spacing between the inlet port and the bleed slot initiating communication with the outlet port, including a bottom dead center position for each interconnecting passage, is relatively less than the angular spacing between the outlet and inlet ports which includes a position corresponding to top dead center, and wherein the valve face is configured to block communication with the outlet port for a predetermined angular rotation of the cylinder barrel before the interconnecting passage reaches the top dead center position and remains blocked for an equivalent or greater angular rotation before communication with the inlet port.

2. The hydraulic pump of claim 1 wherein the angular rotation of the cylinder barrel before top dead center is 10°, and the angular rotation before communication with the inlet port is between 10° and 30°.

3. In a method for reducing noise within a pump of a type having a cylinder head mounted in relation with a rotatable cylinder barrel, the cylinder barrel forming a plurality of bores each reciprocably mounting a piston, the cylinder head forming a high pressure outlet port and a low pressure inlet port circumferentially arranged upon a valve face for periodic communication with the piston bores through respective interconnecting passages formed by the rotatable cylinder barrel, reciprocation of the pistons being timed in accordance with relative rotation between the cylinder head and the cylinder barrel, the steps comprising:

maintaining limited communication for each interconnecting passage with the low pressure inlet port until the respective interconnecting passage traverses a position corresponding to bottom dead center, and thereafter:

initiating limited communication for the respective interconnecting passage with the outlet port prior to entry of the respective interconnecting passage into full communication with the outlet port;

maintaining each respective interconnecting passage out of communication with each of the outlet and inlet ports for a relatively increased time while the respective interconnecting passage is traversing a position of top dead center relative to the period of time during which each respective interconnecting passage is maintained out of communication with both the inlet and outlet ports while traversing a bottom dead center position;

maintaining each respective inerconnecting passage out of communication with the outlet port during a predetermined angular rotation toward its top dead center position; and, increasing the traversal time and distance for each interconnecting passage from a position of top dead center to communication with the inlet port relative to passage of each interconnecting passage out of communication with the outlet port and into its position of top dead center.

4. The method of claim 3 wherein the predetermined angular rotation toward top dead center position is 10°; and, the traversal distance for each interconnecting passage from a position of top dead center position to communication with the inlet port is defined by an angular rotation of between 10° and 30°.

* * * * *

UNITED STATES PATENT OFFICE

CERTIFICATE OF CORRECTION

Patent No. 4,034,652 Dated July 12, 1977

Inventor(s) ROBERT J. HUEBNER

It is certified that error appears in the above-identified patent and that said Letters Patent are hereby corrected as shown below:

Col. 6, claim 3, line 21, change "inerconnecting" to -- interconnecting --.

Signed and Sealed this

*Twenty-fifth* Day of *July 1978*

[SEAL]

*Attest:*

RUTH C. MASON
*Attesting Officer*

DONALD W. BANNER
*Commissioner of Patents and Trademarks*